United States Patent [19]

Ellis

[11] 4,437,400

[45] Mar. 20, 1984

[54] STAMPING DEVICE

[76] Inventor: Charles W. Ellis, 2371 Beach St., Bellmore, N.Y. 11710

[21] Appl. No.: 444,737

[22] Filed: Nov. 26, 1982

Related U.S. Application Data

[63] Continuation of Ser. No. 219,019, Dec. 22, 1980, abandoned.

[51] Int. Cl.[3] ..... B41J 1/02; B41J 3/40; B41J 19/18

[52] U.S. Cl. ..... 101/18; 101/4; 400/307.2; 269/209; 269/211

[58] Field of Search ..... 101/18, 19, 4, 28; 400/307.2; 269/211, 209

[56] References Cited

U.S. PATENT DOCUMENTS

| | | | |
|---|---|---|---|
| 302,346 | 7/1884 | McAuley | 269/209 |
| 444,510 | 1/1891 | Tanner | 269/209 |
| 946,824 | 1/1910 | Pautze | 400/127 |
| 1,426,067 | 8/1922 | Hill | 101/4 |
| 1,600,643 | 9/1926 | Petersen | 101/18 |
| 1,910,918 | 5/1933 | Hehn | 101/4 |
| 1,926,586 | 12/1933 | Haas | 101/4 |
| 2,142,009 | 12/1938 | Siebert | 101/18 |
| 2,262,180 | 11/1941 | Hauer | 101/4 |
| 2,307,268 | 1/1943 | Handley | 400/307.2 |
| 2,322,707 | 6/1943 | Wetzler | 269/209 |
| 2,591,369 | 4/1952 | Mintz | 101/28 |
| 2,815,053 | 12/1957 | Walker | 269/211 |
| 4,030,592 | 6/1977 | Lampman | 400/307.2 |
| 4,079,825 | 3/1978 | Fewell | 101/18 |
| 4,170,345 | 10/1979 | Townsend | 269/211 |

*Primary Examiner*—William Pieprz

*Attorney, Agent, or Firm*—Roylance, Abrams, Berdo & Goodman

[57] ABSTRACT

A stamping device includes a baseplate, a slide mounted on the baseplate, a carriage movably mounted on the slide, and a punch holder coupled to the carriage for movement therewith. The carriage is movable in an adjustable, predetermined indexical manner to allow for precise aligning and positioning of the punch or die imprints.

11 Claims, 6 Drawing Figures

45
46
47
48
79
42
41
43
78
39
44
40
67
56
57
55
68
4
70
74
71
33
34'
35
86
61
54
53
66
72
62
36
58
59
52
31
74'
60
64
63
65
26
32'
30
29
28
49
50
51
25
34
23'
38
11
0.5
1.0
1.5
23'''
20
37
38
31
32
27
12
23''
22
30
28
69
22
18
15
17
82
16
14
19
13
21
10

STAMPING DEVICE

This application is a continuation of application Ser. No. 219,019, filed Dec. 22, 1980, now abandoned.

The present invention relates to a stamping device or tool. More particularly, it relates to a stamping device for imprinting letters, number and other indicia on metal tags, plates, sheets, etc. which mechanically positions, aligns and spaces manually-tapped stamping dies or punches.

Hand stamps or punches for stamping metal tags which are attached to motors, machines, tools, fixtures, etc. are well known and widely used. These steel stamps are hand held over the tag to be stamped, positioned by eye and then tapped by a hammer to make the imprint. This process is then successively repeated for each stamp or punch used, as each punch typically carries only one alpha-numerical character.

As can be readily appreciated, hand stamping in the conventional manner is a rather slow, laborious procedure and because of the difficulty in effecting proper alignment solely by eye, the results are usually unsatisfactory.

Various attempts have been made to improve this hand stamping process. For example, in U.S. Pat. No. 2,262,180, a punch or die holder is disclosed which includes a frame having a row of spaced-apart die-receiving holes formed therethrough for supporting and aligning a plurality of dies. While this die holder would appear to be generally satisfactory, it does not have the capability for adjusting the spacing between the stamps and for precisely aligning the stamps relative to the tag. In addition, it would not appear to adequately prevent relative shifting or sliding between the die holder and the tag to be stamped.

It is therefore an object of the present invention to provide a novel stamping device for imprinting indicia on tags, plates, sheets, etc. which mechanically positions, aligns and spaces manually-tapped stamping dies.

It is a further object of the present invention to provide such a stamping device which allows facile adjustment of the relative spacing between the die imprints and which prevents relative movement between the workpiece and itself.

It is a more particular object of the present invention to provide such a stamping device having the foregoing attributes and characteristics which is relatively simple in construction and operation, dependable and economical to manufacture.

Certain of the foregoing and related objects are readily attained in a stamping device which includes a baseplate, a slide mounted on the baseplate, a carriage movably mounted on the slide, a punch holder coupled to the carriage for movement therewith and means for moving the carriage along the slide.

Preferably, the means for moving includes a rotatable control knob mounted on the carriage for initiating the movement of the carriage along the slide. It also advantageously includes indexing means for controlling movement of the carriage in predetermined increments.

In a preferred embodiment of the invention, the slide has a ratchet-like edge and the means for moving includes a drive gear coupled to the control knob for rotation therewith and disposed for meshing engagement with the ratchet-like edge of the slide. In addition, the indexing means includes an indexing wheel coupled to the control knob for rotation therewith which has a plurality of rows of spaced-apart indexing holes formed around the periphery thereof, with the spacing of the holes in one row being different than the spacing in the other rows. The indexing means further includes an indexing arm and means for pivotably mounting the arm on the carriage for adjustable alignment with one of the rows. The arm has an indexing finger releasably engagable with the holes of the row aligned therewith so as to allow for indexing and advancement of the slide in increments equal to the spacing between successive indexing holes of the aligned row. Most desirably, the means for pivotably mounting includes means for arresting the arm at a fixed orientation in alignment with one of the rows of indexing holes.

In a further advantageous embodiment of the invention, the baseplate includes means for mounting a workpiece thereon which preferably comprises an alignment bar mounted on the baseplate and clamping means releasably and adjustably mounted on the baseplate for clamping and holding a workpiece against the baseplate and alignment bar in a secure fashion. It is particularly desirable that the baseplate have a row of spaced-apart adjustment holes formed therein, which row is disposed generally normally to the alignment bar and wherein the clamping means includes a support base having a pin insertable in one of the holes for adjusting the position of the clamping means relative to the alignment bar.

Most advantageously, the support base has a generally U-shaped configuration and defines a pair of spaced-apart legs and the clamping means includes a clamping arm pivotably supported between the legs having a plate engaging end. The row of adjustment holes are desirably disposed in a recessed channel formed in the baseplate and the plate engaging end is configured for at least partial receipt in the channel. The clamping arm preferably has an externally-threaded section and is pivotably supported between the legs by means of a rotatable cylindrical plug having an internally-threaded bore through which the arm extends by means of the threaded section thereof, so as to allow for retraction or extension of the plate engaging end, relative to the plug.

It is further desirable that the slide be pivotably mounted on the baseplate. The die holder also preferably includes means for releasably supporting a punch therein.

Other objects and features of the present invention will become apparent from the following detailed description when taken in connection with the accompanying drawings which disclose one embodiment of the invention. It is to be understood that the drawings are designed for the purpose of illustration only and are not intended as a definition of the limits of the invention.

In the drawings, wherein similar reference characters denote similar elements throughout the several views.

Figure 1:
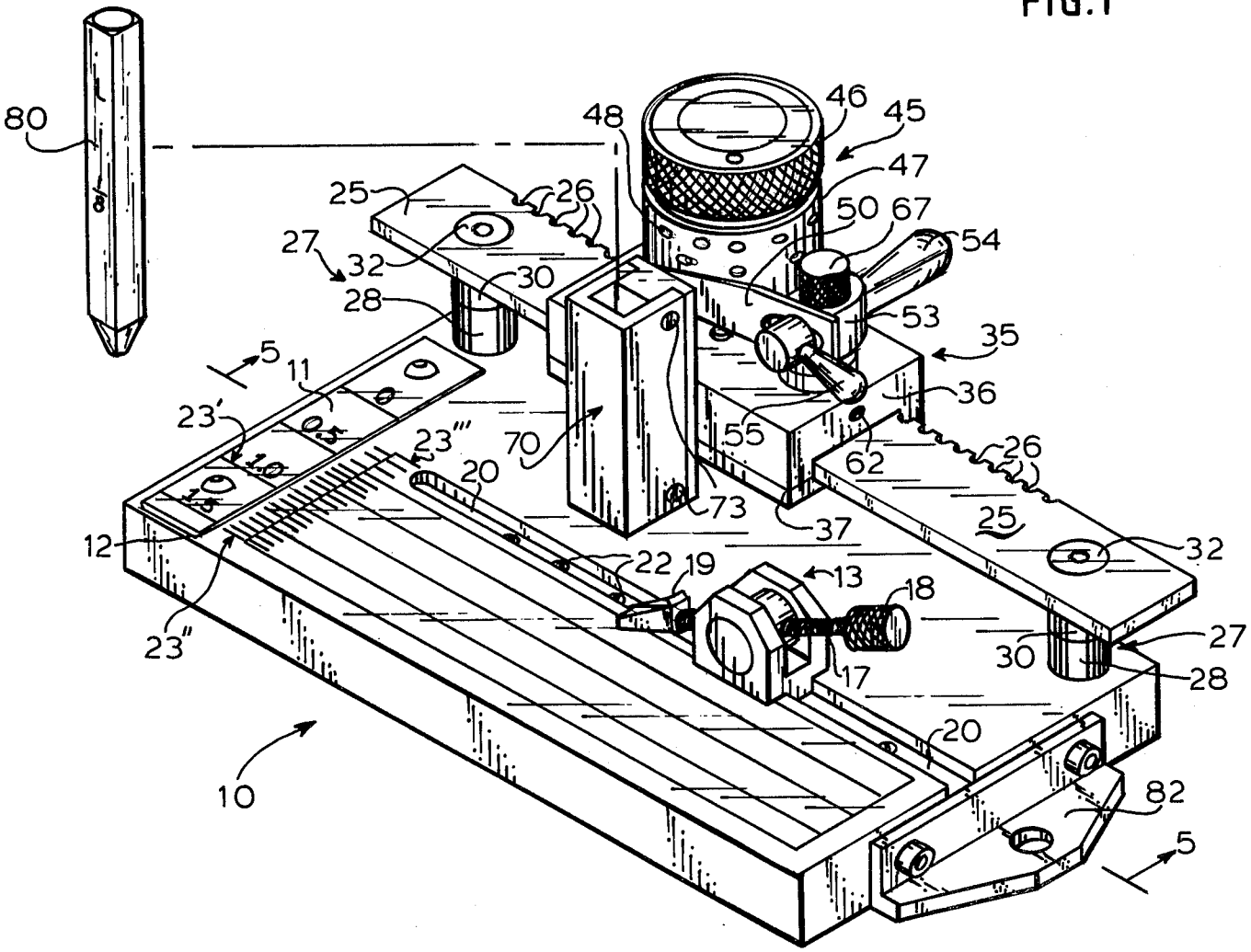
FIG. 1 is a perspective view of a novel stamping device embodying the present invention.
Figure 5:
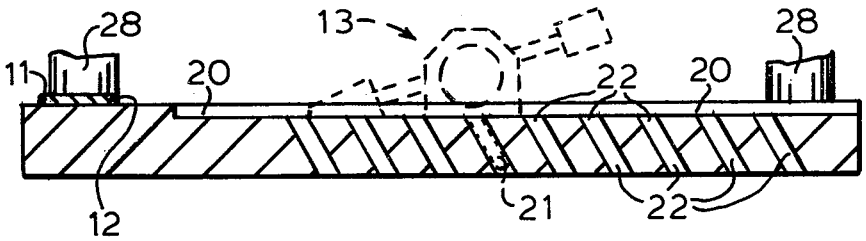
Figure 6:
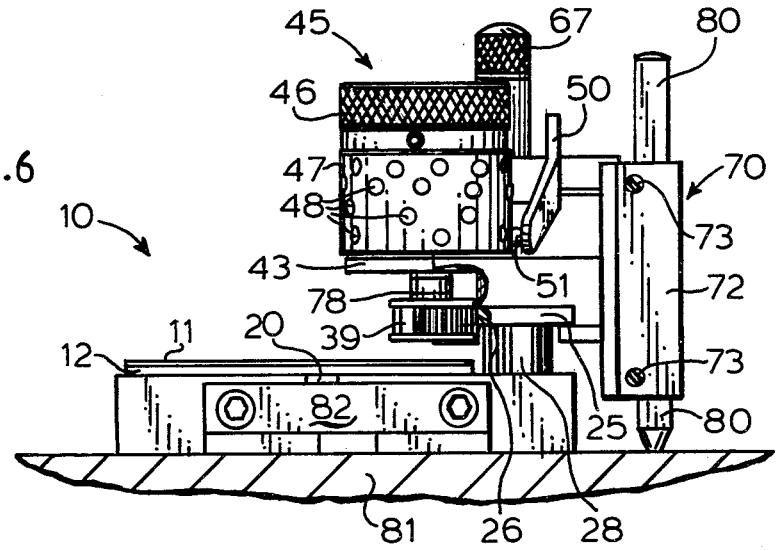

FIG. 5 is a fragmentarily-illustrated cross-sectional view taken along line 5—5 of FIG. 1, further showing the plate clamp mounted on the baseplate, in phantom line; and FIG. 6 is a side elevational view of the stamping device shown in FIG. 1, but showing the punch holder and supporting assembly transposed 180° for operation in an alternate mode for stamping large plates and with portions broken away to show engagement of the teeth of the gear with the teeth of the slide.

Figure 2:
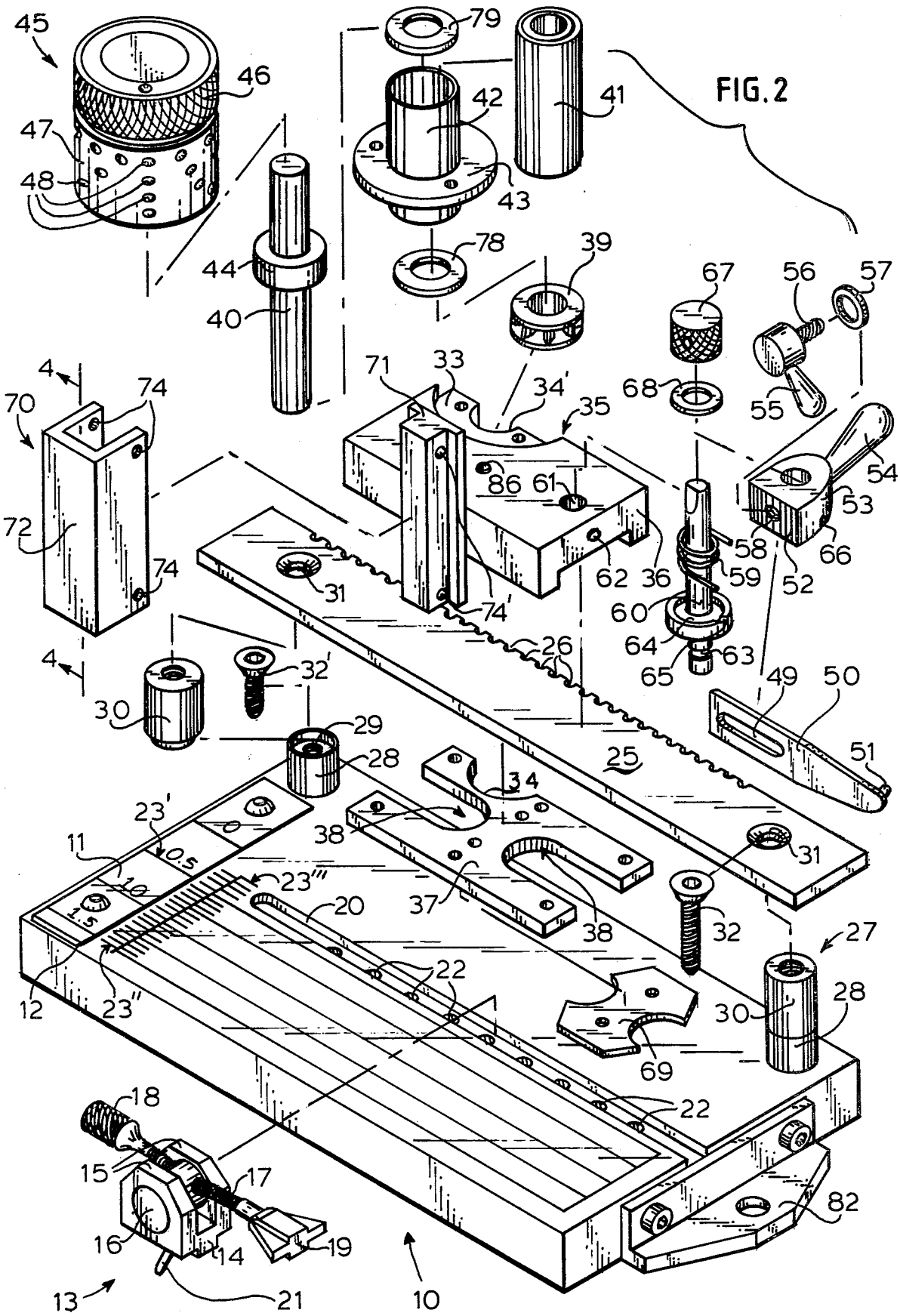
FIG. 2 is an exploded perspective view of the device shown in FIG. 1.

Turning now in detail to the appended drawings, and in particular FIGS. 1 and 2 thereof, therein illustrated is a novel stamping device embodying the present invention. The device primarily includes a rectangular baseplate 10, a slide 25 mounted on baseplate 10, a hand-actuated carriage 35 slidably mounted on slide 25, and a punch or die holder 70 attached to carriage 35.

Baseplate 10 has a generally flat upper surface on which the intended workpiece, e.g., a flat metal tag (not shown), is placed. An alignment bar 11 is mounted on the upper surface adjacent to the left-hand lateral end of baseplate 10 and is provided with a chamfered inner edge 12 to define an overhang under which the lateral edge of the metal tag may be slid for secure mounting. The opposite edge of the tag is held by an adjustable clamping assembly 13.

Clamping assembly 13 includes a generally U-shaped support member which has a base 14 and a pair of upright, spaced-apart legs 15, the latter of which pivotably support a cylindrical plug 16. Plug 16 has a centrally-disposed, internally-threaded through bore in which is received the externally-threaded shaft of a clamping arm 17 having a handle 18 at one end thereof and a generally cross-shaped rotatable clamping head 19 at its other end.

The longer, horizontally-oriented arm of the cross-shaped clamping head 19 is intended to abut the opposing lateral edge of the metal tag and the ends of the vertically-oriented shorter arms of clamping head 19 are designed for sliding receipt within a complementary-configured channel 20 formed in the upper surface of baseplate 10, which channel 20 is aligned generally normally to alignment bar 11. The underside of support member base 14 is similarly configured as clamping head 19 so as to allow for partial sliding receipt thereof in channel 20 as well. In addition, base 14 is further provided with a downwardly depending, obliquely angled support pin 21 which is intended for receipt within one of the comparably angled support holes 22 provided in the base of channel 20, as shown more clearly in FIG. 5.

As a result of the cooperation between channel 20 and the row of holes 22 and the complementary-configured surfaces of the support member base 14 and clamping head 19 of clamping assembly 13, the latter may be securely mounted on baseplate 10 in an adjustable but fixed position so as to, in turn, permit mounting of the metal tag on baseplate 10 in a securely clamped manner between alignment bar 11 and clamping assembly 13.

As can be appreciated, the row of holes 22 allows for gross adjustment and positioning of the clamping assembly relative to the metal tag placed on baseplate 10. Fine adjustment is effected by rotation of handle 18 to effect either extension or retraction of clamping arm 17, relative to plug 16, to thereby tighten or relax its clamping grip. The pivotable mounting of arm 17 facilitates both the gross and fine clamping adjustments thereof.

Alignment bar 11 and baseplate 10 are provided with vertical rows of scale markings 23′ and 23″, 23‴, respectively, on the upper surfaces thereon so as to enable proper positioning of the metal plate on baseplate 10 and to serve as a guide during the imprinting procedure. The scale markings 23′, 23″, 23‴ may represent ½″, 1/16″ and 1/32″ increments, for example.

A slide or slide bar 25 having a tooth rear edge 26 is mounted on baseplate 10, spaced thereabove by means of a pair of segmented support columns 27. As seen more clearly in FIG. 2, support columns 27 each include a lower cylindrical support member 28 which is secured to baseplate 10 and which has an internally-threaded bore 29 and an upper cylindrical spacer collar 30 which has a lower end configured for nesting receipt within the upper end of support member 28. Slide 25 is provided with a pair of countersunk mounting holes 31 alignable with support columns 27 and is fastened to columns 27 by means of hex-type screws 32, intended for threaded receipt in bores 29 of support member 28; the purpose of the shorter screw 32′ shown in FIG. 2 will be explained below with respect to the FIG. 6 embodiment.

Mounted on slide 25 for sliding movement is a movable carriage 35 consisting of a generally inverted U-shaped upper housing 36 and a generally H-shaped lower support plate 37 which are joined together with slide 25 disposed therebetween. Lower support plate 37 is provided with two generally U-shaped, cut-out portions 38 so as to maximize the length of the travel path of carriage 35 along slide 25, without interference from support columns 27; a cushioning pad 69 is affixed underneath support plate 37 to cushion the engagement therewith with support columns 27. In addition, both lower support member 37 and upper housing portion 36 are provided with a generally semicircular cut-out portion 34, 34′, respectively, to allow for partial receipt therein of a gear or ratchet wheel 39 intended for meshing engagement with toothed surface 26 of slide 25.

Gear 39 is mounted on the lower end of a shaft 40 which, in turn, is rotatably received within a bearing casing 41. Casing 41 is frictionally received in a cylindrical support sleeve 42. Sleeve 42 has a central collar 43 which is received on a complementary-configured recessed portion 33 of upper housing segment 36.

Gear 39 is disposed outwardly of the lower end of sleeve 42, spaced therefrom by means of washer 78. The upper end of shaft 40 and a collar 44 thereof extend above sleeve 42, with shaft collar 44 resting on washer 79. A cylindrical control knob 45 is secured to the upper end of shaft 40. Knob 45 comprises an upper finger gripping portion 46 and a lower indexing wheel 47 having four horizontal rows of holes 48 formed in the circumferential surface thereof in a predetermined spacing arrangement so as to allow for sliding movement of carriage 35 according to set increments, as will be discussed in greater detail hereinafter.

Also mounted on carriage 35 is an indexing adjustment assembly which includes a slotted indexing arm 50 having an adjustment slot 49 adjacent one end thereof and a pin 51 at the other end thereof for successive releasable engagement with the holes of one of the rows of indexing holes of indexing wheel 47. Indexing arm 50 is supported against the serrated end 52 of a base 53 of a pivot release arm 54 by means of a clamping handle 55 having a threaded shaft 56 for receipt, with the interposition therebetween of a washer 57, in a threaded bore 58 of the serrated surface 52. As can be appreciated by turning handle 55 in either one or the other direction, clamping arm 50 will become loosened or tightened accordingly; slot 49 thereof alllowing for relative longitudinal displacement, as well as pivoting thereof.

Pivot release arm 54 is mounted in a spring-biased manner, by means of a coil spring 59, on a shaft 60 which, in turn, is received in a bore 61 of upper housing 36 and held in a fixed manner therein by a set screw insertable in a threaded bore 62 in the end face of upper housing 36 for engagement with a recessed annular channel 63 of shaft 60. Spring 59 rests on a centrally-recessed collar 64 with the lower end thereof received in a cut-out portion 65 of the collar rim and with the upper end thereof received in a groove 66 provided in the base 53 of arm 54. A finger grip cylindrical cap 67 and a washer 68 are secured on the top of shaft 60 to hold arm 54 in place. To pre-load spring 59 and, in turn, urge indexing arm 50 against wheel 47, cylindrical cap 67 is turned clockwise; this, of course, requiring the initial loosening and subsequent tightening of the set screw in bore 62.

Figure 4:
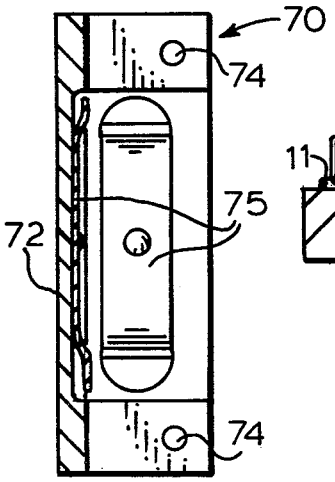
FIG. 4 is a cross-sectional view taken along line 4—4 of FIG. 2.

Also attached to carriage 35 along one side thereof vertically-disposed is a die holder 70 consisting of a elongated T-shaped bar 71 affixed to carriage 35 and a generally U-shaped outer housing segment 72 which is secured to T-shaped bar 71 by means of screws 73 received in aligned holes 74, 74' of segment 72 and bar 71, respectively, the latter of which are threaded, so as to define a generally square-shaped, vertically-extending channel therebetween. As can be seen more clearly in FIG. 4, two leaf springs 75 are mounted on U-shaped housing segment 72 which serve to biasly retain a punch 80 therein.

Turning now to the overall operation of the device, initially the metal tag would be placed on baseplate 10 with its lateral edge abutting chamfered edge 12 of alignment bar 11. The plate clamp 13 would then be positioned as close as possible to the metal tag with its pin 21 received in one of the holes 22 of groove 20 and with the lower surfaces of base 14 and clamping head 19 in channel 20. Then, handle 18 of clamping arm 17 would be turned to effect tightening of its clamping head 19 against the metal plate. With the metal plate now firmly and securely in place, indexing arm 50 would be adjusted to align pin 51 thereof with the desired set row of indexing holes; this being effected by initially loosening clamping arm holds of handle 55 so as to allow for pivoting and displacement of clamping arm 50 to a position in alignment with one of the horizontal row of holes 48, after which, handle 55 would then be tightened to maintain this position. The device would then be ready for stamping the tag.

The first punch 80 would be inserted into die holder 70 and tapped by a hammer or other tool. After the impression was made, punch 80 would be removed and then control knob 45 would be turned until the next hole in the row is reached by pin 51; this change of position is automatically effected by turning of indexing wheel 47. This process would then be repeated until the desired set of indicia was imprinted on the metal tag.

Figure 3:
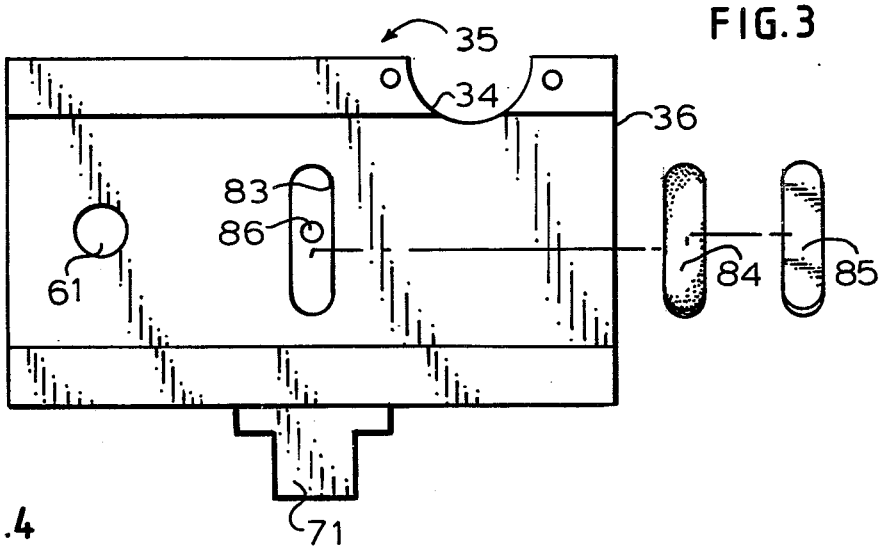
FIG. 3 is a bottom view of the upper housing of the carriage with the lubrication pads removed and displaced to show internal configuration.

As shown in FIG. 3, the lower surface of upper housing 36 of carriage 35 is provided with an oblong recess 83 in which a lubricant storage pad 84 and a support pad 85 are mounted. A hole 86 leads from the upper surface of housing 36 to recess 83 to allow for oil or another suitable lubricant to be fed to pad 84 which, in turn, lubricates slide 25 to facilitate sliding of carriage 35 thereon.

As shown in FIG. 6, in case one wants to stamp a large sheet 81 which cannot be placed on baseplate 10, slide 25 and carriage 35 are removed from baseplate 10 and transposed 180° so as to position punch holder 70 beyond the rear edge of baseplate 10. However, before mounting thereof in this reversed position, spacer collars 30 of support columns 27 which have a height equal to that of baseplate 10 are removed so as to accomodate the lowering of the working height (i.e., from the upper to the lower surface of baseplate 10). In this case, the shorter screws 32 would be used to mount slide 25 on baseplate 10. In addition, baseplate 10 may be provided with generally L-shaped flanges 82 secured to the lateral ends thereof for securing the same in a rigid, non-movable position to a support plate, if so desired.

As will be appreciated, various modifications may be made as will be apparent to those skilled in the art. For example, the stamping tool may be made from a variety of materials, although metal and, in particular, steel is preferred. In addition, although the clamping assembly disclosed has been found to be particularly advantageous, other clamping arrangements might prove satisfactory.

Thus, while only one embodiment of the present invention has been shown and described, it will be obvious that many changes and modifications may be made thereunto, without departing from the spirit and scope of the invention.

What is claimed is:

1. A stamping device for a workpiece, the combination comprising:

a baseplate having a top surface;

a slide rigidly coupled to said baseplate top surface and space therefrom, said slide having a ratchet-like edge;

a carriage slidably coupled to said slide and supporting a punch holder, said punch holder having a longitudinal axis substantially perpendicular to said top surface and adapted to receive a punch therein for stamping the workpiece;

indexing means, coupled to said carriage and slide, for moving said carriage in predetermined increments longitudinally relative to said slide and baseplate to selectively position said punch holder over the workpiece, said indexing means including a manually-operated, rotatable knob coupled to a drive gear which is in turn coupled to said slide ratchet-like edge, and means for coupling said slide to said baseplate in first and second positions, said first position locating said punch holder over said baseplate and said second position locating said punch holder past an edge of said baseplate.

2. A stamping device according to claim 1, and further comprising a clamping assembly supported on said baseplate top surface for releasably clamping the workpiece on said baseplate top surface, said clamping assembly including an alignment bar rigidly coupled to said baseplate and a clamping means releasably coupled to said baseplate for longitudinal movement therealong.

3. A stamping device according to claim 2, and further comprising scale marking means, located on said baseplate top surface, for allowing accurate repeatable positioning of workpieces relative to said baseplate.

4. The stamping device according to claim 2, wherein said baseplate has a row of spaced-apart adjustment holes formed therein disposed generally normally to said alignment bar and wherein said clamping means includes a support base having a pin insertable in one of said holes for adjusting the position of said clamping means relative to said alignment bar.

5. The stamping device according to claim 4, wherein said support base has a generally U-shaped configuration and defines a pair of spaced-apart legs and wherein said clamping means includes a clamping arm pivotably supported between said legs having a plate engaging end.

6. The stamping device according to claim 5, wherein said row of adjustment holes are disposed in a recessed channel formed in said baseplate and wherein said plate engaging end is configured for at least partial receipt in said channel.

7. The stamping device according to claim 6, wherein said clamping arm has an externally-threaded section and is pivotably supported between said legs by means of a rotatable cylindrical plug having an internally-threaded bore through which said arm extends by means of said threaded section thereof so as to allow for retraction or extension of said plate engaging end relative to said plug.

8. A stamping device according to claim 1, and further comprising leaf spring means, coupled to said punch holder, for biasing the punch against said punch holder.

9. The stamping device according to claim 5, wherein said indexing means includes an indexing wheel coupled to said control knob for rotation therewith which has a plurality of rows of spaced-apart indexing holes formed around the periphery thereof, with the spacing of the holes in one row being different than the spacing of the holes in the other rows, said indexing means further including an indexing arm and means for pivotably mounting said arm on said carriage for adjustable alignment with one of said rows, said arm having an indexing finger releasably engagable with the holes of the row aligned therewith so as to allow for indexing and advancement of said slide in increments equal to the spacing between successive indexing holes of said aligned row.

10. The stamping device according to claim 9, wherein said means for pivotably mounting includes means for arresting said arm at a fixed orientation in alignment with one of said rows of indexing holes.

11. A stamping device for a generally flat workpiece, the combination comprising:

a baseplate having a planar top surface;

a clamping assembly supported on said baseplate top surface for releasably clamping the workpiece in a generally flat position on said baseplate top surface, said clamping assembly including an alignment bar rigidly coupled to said baseplate and a clamp releasably coupled to said baseplate for longitudinal movement therealong;

a generally planar slide rigidly coupled to said baseplate top surface and spaced therefrom, said slide having a ratchet-like, straight edge;

a carriage slidably coupled to said slide and supporting a punch holder, said punch holder having a longitudinal axis substantially perpendicular to said planar top surface and adapted to receive a punch therein for stamping the workpiece;

indexing means, coupled to said carriage and slide, for moving said carriage in predetermined increments longitudinally relative to said slide and baseplate to selectively position said punch holder over the workpiece, said indexing means including a manually-operated, rotatable knob coupled to a drive gear which is in turn coupled to said slide ratchet-like edge; and scale marking means, located on said top surface of said baseplate, for allowing accurate and repeatable positioning of workpieces relative to said baseplate; and means for coupling said slide to said baseplate in first and second positions, said first position locating said punch holder over said baseplate and said second position locating said punch holder past an edge of said baseplate.

* * * * *